US006934221B2

(12) United States Patent
Willemin et al.

(10) Patent No.: US 6,934,221 B2
(45) Date of Patent: Aug. 23, 2005

(54) TIMEPIECE WITH A DATE MECHANISM COMPRISING TWO SUPERPOSED DATE RINGS

(75) Inventors: Roger Willemin, Grenchen (CH); Roger Metzger, Aarau (CH); Marco Bettelini, Prêles (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 10/991,489

(22) Filed: Nov. 19, 2004

(65) Prior Publication Data

US 2005/0111302 A1 May 26, 2005

(30) Foreign Application Priority Data

Nov. 26, 2003 (EP) ..... 03027147

(51) Int. Cl.[7] ..... B04B 19/24
(52) U.S. Cl. ..... 368/28; 368/35; 368/37
(58) Field of Search ..... 368/28, 34–38

(56) References Cited

U.S. PATENT DOCUMENTS 4,257,113 A * 3/1981 Meister et al. ..... 368/35

(Continued)

FOREIGN PATENT DOCUMENTS

CH 660 941 A 6/1987

(Continued)

OTHER PUBLICATIONS

European Search Report, completed Jun. 21, 2004.

*Primary Examiner*—Vit W. Miska
(74) *Attorney, Agent, or Firm*—Griffin & Szipl, P.C.

(57) ABSTRACT

Date mechanism for a timepiece such as a wristwatch including two superposed respectively lower (6) and upper (4) date rings, whose surface is divided into a plurality of sectors, the upper ring (4) including sixteen sectors, fifteen of which respectively bear fifteen successive markings of a cycle of 31 positions, and the sixteenth of which is an extra sector having an open or transparent aperture (8), whereas the lower ring (6) includes seventeen sectors, sixteen of which bear respectively the other sixteen markings of the cycle of 31 positions, and the seventeenth of which is an extra sector, each of said rings cooperating with drive means such that the markings appear successively in a display zone (20) the date mechanism further including a jumper-effect stopping device (22) able to stop each ring (4, 6) in any desired position, the date mechanism being characterised in that one location on the upper ring (4) and one location on the lower ring (6) is provided with a thinned tooth (14) and (16), located between two successive teeth (10) or (12) of the toothing of the ring (4) or (6) concerned, the position of the drive means with respect to the toothing of the rings (4, 6) being such that when a ring (4) or (6) has its extra sector at the location of the display zone (20), the thinned tooth (14) or (16) is located opposite the drive means such that said drive means only drive the other ring, the thinned teeth (14, 16) not disturbing the movement of the drive means and allowing the stopping device (22) to be constantly housed between two successive teeth (10) or (12) of each of the rings (4, 6).

4 Claims, 6 Drawing Sheets

U.S. PATENT DOCUMENTS

| | | | | |
|---|---|---|---|---|
| 6,711,100 | B2 * | 3/2004 | Rochat et al. | 368/35 |
| 6,735,151 | B2 * | 5/2004 | Triponez | 368/28 |
| 6,738,316 | B2 * | 5/2004 | Gabathuler et al. | 368/28 |

FOREIGN PATENT DOCUMENTS

| | | |
|---|---|---|
| DE | 198 45 539 A | 4/2000 |
| GB | 957 031 A | 5/1964 |

* cited by examiner

TIMEPIECE WITH A DATE MECHANISM COMPRISING TWO SUPERPOSED DATE RINGS

This application claims priority from European Patent Application No. 03027147.2 filed Nov. 26, 2003, the entire disclosure of which is incorporated herein by reference.

The present invention concerns a large date mechanism including two, respectively upper and lower, superposed date rings, one of which carries fifteen successive markings of a cycle of 31 positions, whereas the other carries the other sixteen markings.

Cyclical counting and display devices with an aperture used in calendar timepieces for displaying the date are already known. Usually, the analogue display of the date is conventionally made using a date ring which comprises 31 sectors bearing the markings from 1 to 31. However, such a device has the drawback of only offering one field for each sector, whose dimensions correspond to a $31^{st}$ of the circumference of the ring. In particular in wristwatches of small format, the dimensions of said field are insufficient to allow a date display that is easily readable. The need for a device allowing a "large date" to be displayed on a much larger field than a $31^{st}$ of a circumference has thus been felt.

A first solution to this problem was provided by Swiss Patent Application No CH 660 941 in the name of Brandi, the purpose of which is to provide and cyclical counting and display device with an aperture for a watch calendar which, while being purely mechanical and of simple configuration, enables the date indication to have a large format, at least approximately twice that of a $31^{st}$ of a circumference.

Thus, the Brandi Patent discloses a date mechanism mainly comprising an upper date ring of sixteen sectors, superposed on a lower ring comprising seventeen sectors. On fifteen of its sectors the upper ring bears the markings "17" to "31", whereas the last sector is provided with an aperture. On sixteen of its sectors the lower ring includes the markings "1" to "16", whereas the last sector is free of any marking. The inner circumference of the two rings includes teeth, a place for the upper ring and a place for the lower ring being free of teeth. A data drive finger, conventionally making one revolution every twenty-four hours, drives the date rings in a conventional manner, by acting on their teeth. The position of the drive finger with respect to the toothing of the rings is such that, when a ring is in its free position (aperture for the upper ring and sector free of marking for the lower ring) at the watch display location, the drive finger is located facing the tooth free position of the ring concerned.

The Brandi Patent provides a date mechanism for a timepiece that advantageously enables the date indication to be given a large format, substantially twice that of a conventional date mechanism. However, it raises a problem as regards the positioning of the date rings. In fact, in accordance with the Brandi Patent, two jumper-effect stopping devices respectively act on the teeth of the upper ring and on the teeth of the lower ring. However, given that one location on the toothing of each of said rings has no teeth, these jumpers have to have dual tips and press on the tips of three successive teeth. These jumpers must consequently be of large dimensions and are thus bulky. Moreover, the mechanical features of the hold exerted by the jumpers on the two date rings are different depending upon whether the missing tooth is in the first, second or third position as regards said jumpers. A compromise thus has to be found that guarantees that, whatever the position of the missing tooth, the jumpers ensures a satisfactory positioning of the ring concerned. Such jumpers are thus difficult to obtain.

It is an object of the present invention to overcome the aforementioned drawbacks, in addition to others, by providing a date mechanism enabling the date indication to be given a large format, this mechanism including two superposed, respectively upper and lower, date rings, one of which bears fifteen successive markings of a cycle of 31 positions, whereas the other bears the other sixteen markings, a jumper-effect stopping device for positioning the two rings properly.

The present invention thus concerns a date mechanism for a timepiece such as a wristwatch including two superposed, respectively upper and lower, date rings, whose surface is divided into a plurality of sectors, the upper ring including sixteen sectors, fifteen of which respectively bear fifteen successive markings of a cycle of 31 positions, and the sixteenth of which is an extra sector having an open or transparent aperture, whereas the lower ring includes seventeen sectors, sixteen of which respectively bear the other sixteen markings of the cycle of 31 positions and the seventeenth of which is an extra sector, each of these rings being provided with a peripheral toothing made of a succession of regularly spaced teeth cooperating with drive means such that the markings of the lower ring appear successively in a display zone through the aperture, the upper ring remaining immobile, and such that since the lower ring is immobile, the markings of the upper ring then successively appear in the display zone, the upper ring covering the markings of the lower ring, the date mechanism further including a jumper-effect stopping device able to stop each ring in any desired position, the stopping device being adapted to the step of the particular ring concerned, said date mechanism being characterised in that at one location on the upper ring and one location on the lower ring there is provided a thinned tooth located between two successive teeth of the toothing of the ring concerned, the position of the drive means with respect to the toothing of the rings being such that when a ring has its extra sector at the location of the display zone, the thinned tooth is located opposite the drive means, such that said drive means only drive the other ring, the thinned teeth of the two rings not disturbing the movement of the drive means and allowing the stopping device to be constantly housed between two successive teeth of each of the rings.

Owing to these features, the present invention provides a date mechanism for a timepiece, including jumper-effect stopping means that is easy to manufacture and allows the two date rings to be properly positioned. In fact unlike the prior art, where, because of the fact that one location of the toothing of each of the date rings was tooth free, the jumpers had to have a dual tip and press between the tips of three successive teeth, the jumpers according to the invention are constantly housed between two successive teeth of each of the toothings of the rings, even during passage of the thinned tooth. The jumpers according to the invention thus end conventionally in two inclined planes which press between the tips of two immediately successive teeth to keep the date ring concerned in the desired position. These jumpers are thus of conventional design and exert a holding force of constant intensity on the date rings, whatever the position of said rings.

Other features and advantages of the present invention will appear more clearly from the following detailed description of an embodiment of the date mechanism according to the invention, this example being given purely by way of illustrative and non limiting example, in conjunction with the annexed drawing, in which.

The present invention proceeds from the general inventive idea which consists in providing a date mechanism for a timepiece whose jumper-effect stopping device includes two compact jumpers that are easy to manufacture and guarantee proper positioning of the date discs. This result is achieved due to the fact that, unlike the prior art where because of the fact that one location on the toothing of each of the date rings had no tooth, the jumpers had to cooperate with three successive teeth of the toothing of each of the rings to guarantee the positioning of said rings even during passage of the missing tooth, according to the invention, the missing tooth is replaced by a thinned tooth. This thinned tooth plays the same part as the missing tooth, namely defining an extended rest position for the date ring concerned when the latter has its free position at the display location of the watch, but it guarantees that the jumper will be constantly housed between two successive teeth of the toothing of said ring. These jumpers are thus of the conventional type and exert a constant holding force on the date rings, even during passage of the thinned tooth.

Figure 1:
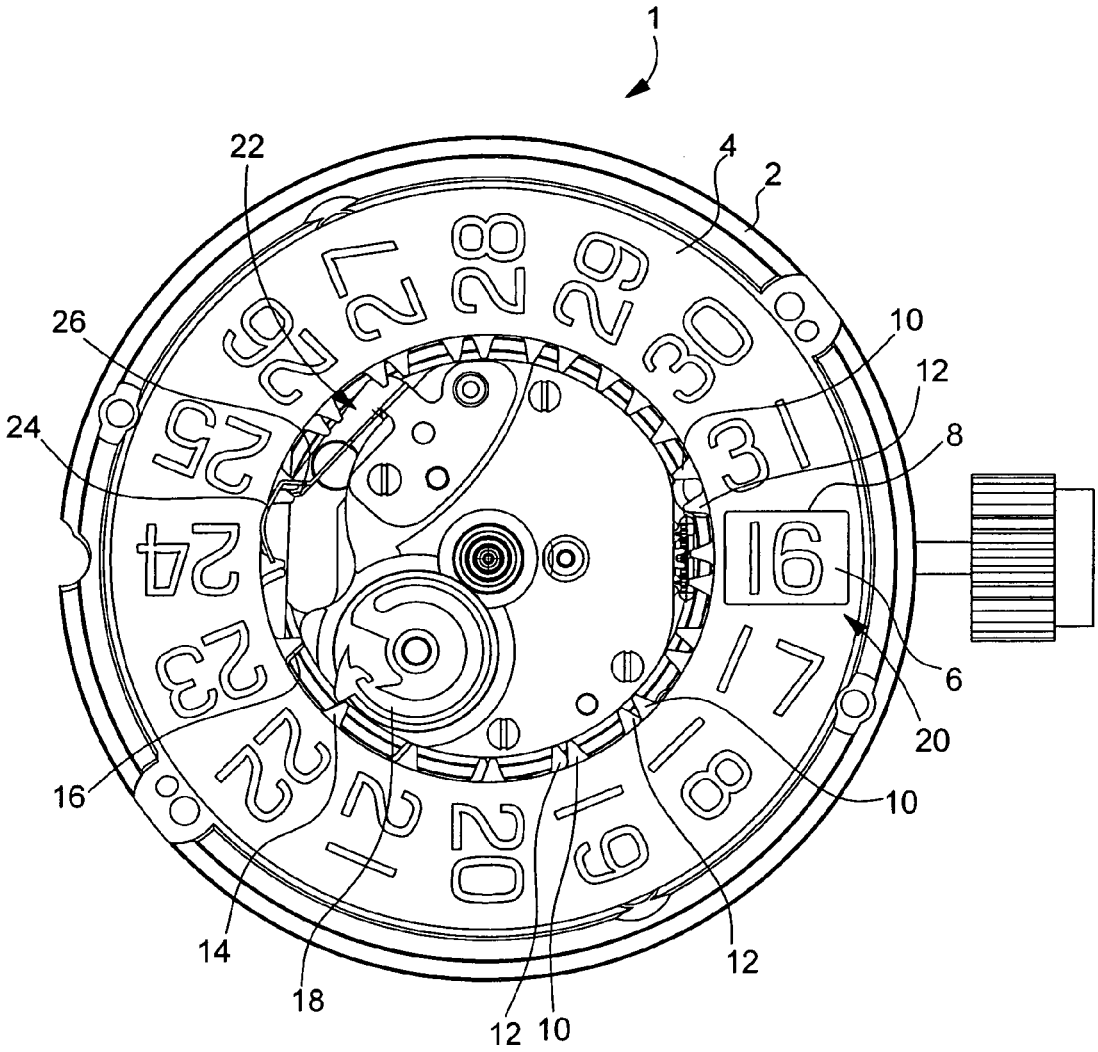
FIG. 1 is a top view of a watchcase including a date mechanism according to the invention.

FIG. 1 is a top view of a watch movement including a date mechanism in accordance with the invention. Designated as a whole by the general reference numeral 1, the movement is mounted in a casing ring 2. The date mechanism according to the invention mainly includes an upper date ring 4 superposed on a lower date ring 6. The upper date ring 4 includes sixteen sectors, whereas the lower date ring 6 has seventeen sectors. As can been seen upon examining FIG. 1 and even better upon examining FIGS. 2 and 3, on fifteen of its sectors, upper ring 4 bears the markings "17" to "31" on fifteen of its sectors, whereas the last sector is provided with an aperture 8 that is open or transparent. Lower ring 6 includes the markings "1" to "16" on sixteen of its sectors, whereas the last sector is free of any marking.

The inner circumference of upper date ring 4 includes a toothing formed of a succession of regularly spaced teeth designated 10 for upper ring 4 and 12 for lower ring 6. One location of the toothing of upper and lower rings 4 and 6 is provided with thinned tooth designated 14 and 16. A "thinned tooth" means a tooth whose height, considered in the direction perpendicular to the plane in which date rings 4 and 6 extend, is less than that of the teeth which precede and follow it.

A date drive wheel 18, conventionally making one revolution every twenty-four hours, drives date rings 4 and 6 in a conventional manner, by acting on teeth 10 or 12. The position of drive wheel 18 with respect to the toothing of upper ring 4 and lower ring 6 is such that, when one of these rings has its free position (aperture 8 for upper ring 4 and marking free sector for lower ring 6) at display location 20 of watch movement 1 (aperture of the dial, which would occupy the position of the number "16", assumed to be removed), drive wheel 18 is opposite thinned tooth 14 or 16 of the ring concerned.

A jumper-effect stopping device 22 includes two jumpers 24 and 26 acting on teeth 10 of upper ring 4 and on teeth 12 of lower ring 6. Unlike the prior art where, because one location of the toothing of each of the date rings has no tooth, the jumpers have to cooperate with three successive teeth of the toothing of each of the rings to guarantee the proper positioning of said rings even during passage of the missing tooth, the present invention proposes replacing the missing tooth by a thinned tooth, i.e. not as high as the other teeth arranged along the inner periphery of upper and lower date rings 4 and 6. As will be seen in detail hereinafter, the thinned tooth according to the invention plays the same part as the missing tooth according to the prior art, namely defining an extended rest position for the date ring concerned when the latter has its free position at display location 20 of the watch, but, by its presence, guarantees that the jumper will be constantly housed between two immediately consecutive teeth of the toothing of said ring.

Figure 2:
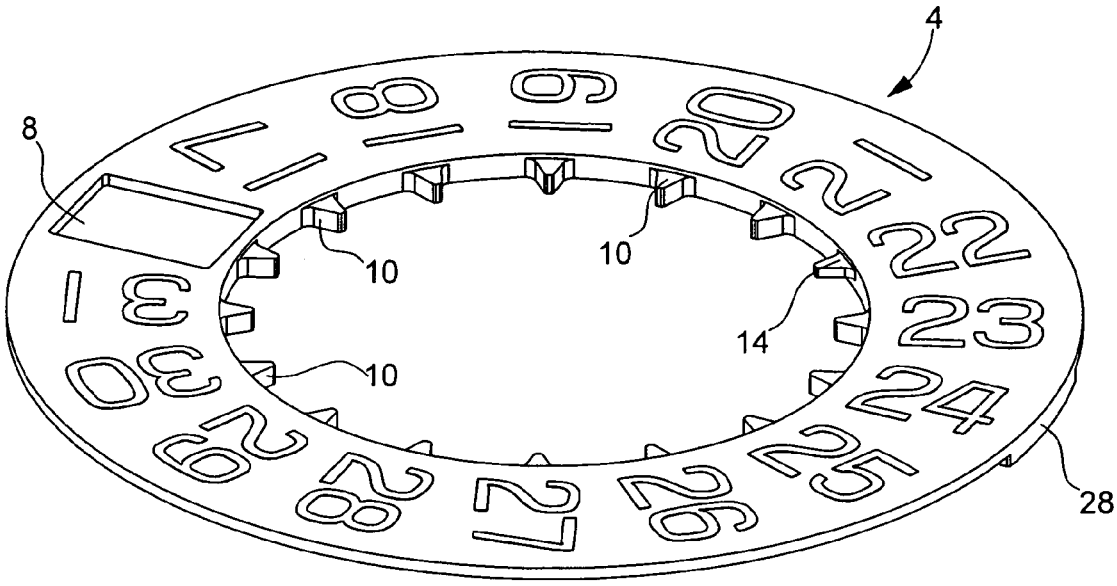
FIG. 2 is a perspective view of the upper date ring.
Figure 3:
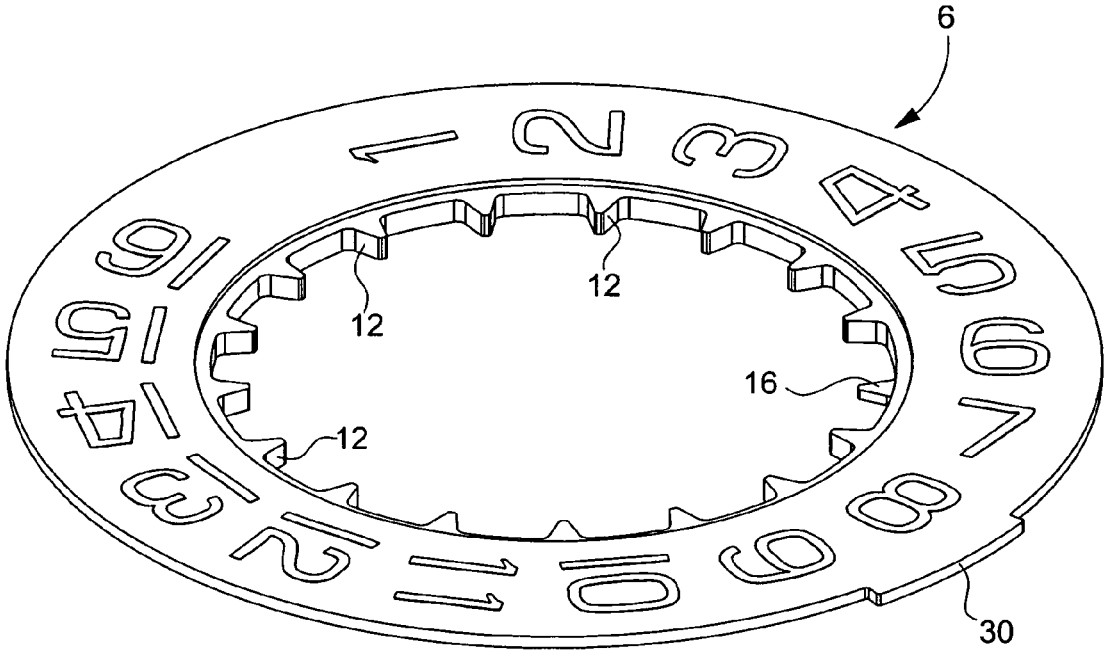
FIG. 3 is a perspective view of the lower date ring.

On their external circumference, date rings 4 and 6 each have a limit stop, respectively 28 and 30. FIGS. 2 and 3 show the detail of this arrangement. Limit stop 28 extends perpendicularly to the plane of upper date ring 4, whereas limit stop 30 extends radially outside the external perimeter of lower date ring 6.

Figure 4:
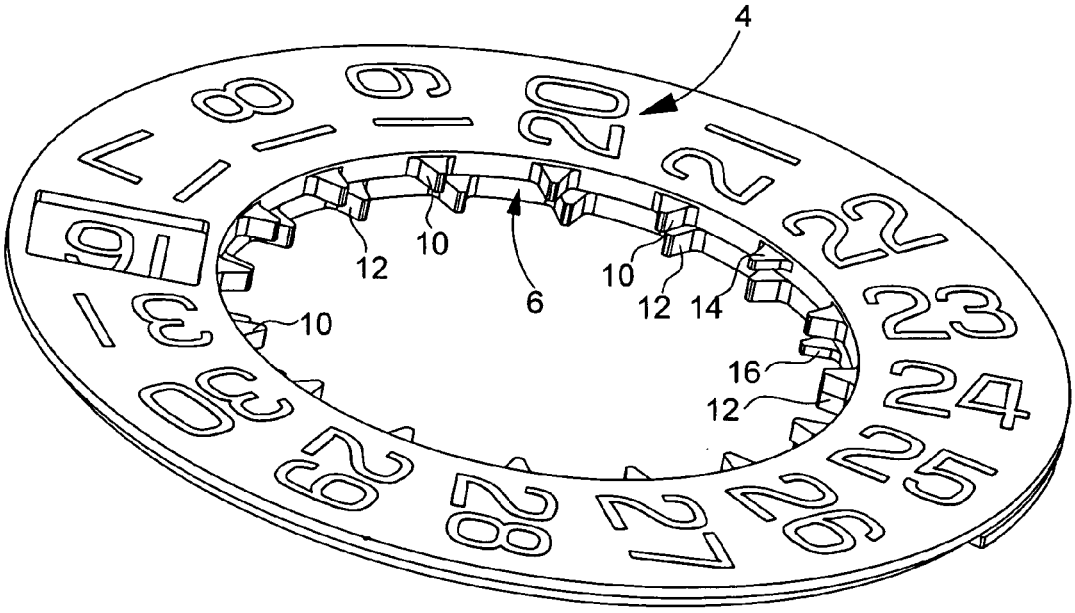
FIG. 4 is a similar view to that of FIGS. 2 and 3, the lower and upper date rings being superposed.

In the situation shown in FIG. 4, upper date ring 4 has its aperture 8 at the display location 20 and simultaneously its thinned tooth 14 opposite drive wheel 18. It is clear that the height of thinned tooth 14 is such that drive wheel 18 cannot mesh with said tooth and only drives lower date ring 6, which, in order to reach the position shown, has been successively brought into the situations where it revealed the markings "11", "12", . . . "15" and finally "16" by drive wheel 18. At the moment when the marking "16" appears, limit stop 30 abuts against limit stop 28. At this moment, during the forward movement that will be imparted to lower ring 6 by drive wheel 18, upper ring 4 will also be driven, such that aperture 8 will disappear from display location 20 to make way for marking "17" of upper ring 4. At this moment, it will be lower ring 6 that has its thinned tooth 16 opposite drive wheel 18. Likewise for upper ring 4, the height of thinned tooth 16 is such that drive wheel 18 cannot mesh with said tooth 16 and drives only upper date ring 4. Thus, upon each revolution of drive wheel 18, only upper ring 4 will move forward by one step, successively causing markings "17", "18", . . . , "30" and "31" to appear. When marking "31" is displayed, the situation between the two limit stops 28 and 30 will be the reverse of that described hereinbefore, i.e. limit stop 28 of date ring 4, abutting against limit stop 30 of lower date ring 6, will simultaneously cause date ring 6 to move forward, during the forward movement of date ring 4, which will cause marking "1" to appear under aperture 8, at display location 20. During all the time that upper ring 4 was moved whereas lower ring 6 was at rest, it was the marking free sector of the latter which was opposite display location 20, this being however without any effect since, in this case, aperture 8 has never been at the display location and has thus never allowed lower ring 6 to be seen. Next, the sixteen markings of lower ring 6 are successively paraded, until we return to the situation shown in FIG. 4. The cycle is then repeated.

Figure 5:
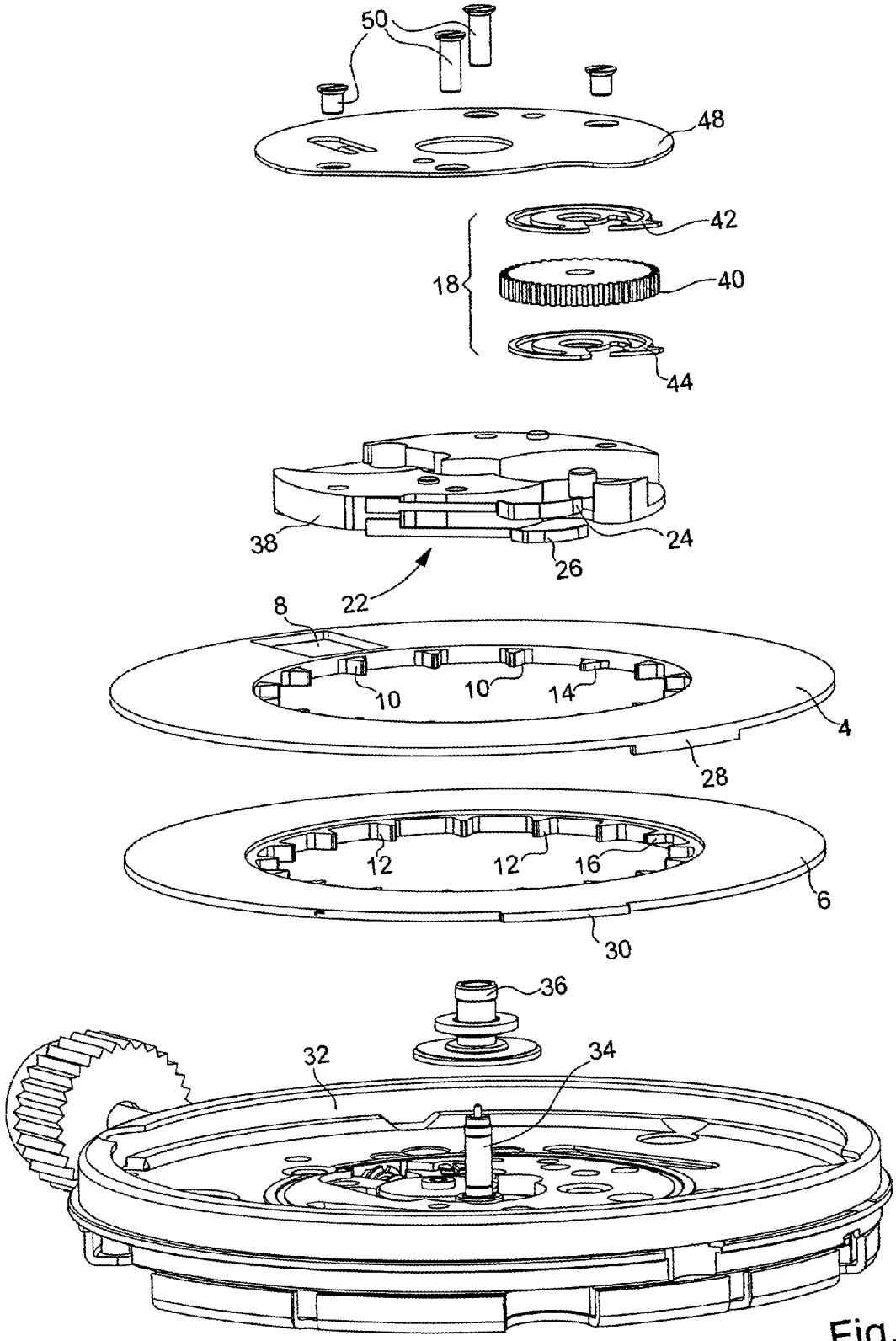
FIG. 5 is an exploded view of the date mechanism.

FIG. 5 is an exploded view of movement 1 provided with the date mechanism according to the invention. This movement 1 includes a plate 2, which supports and guides in rotation the two lower and upper date rings 6 and 4. At the centre of plate 2, in a conventional manner, stands the hour wheel arbour 34 on which the hour wheel 36 is engaged. A bridge 38 carries stopping device 22 provided with its two jumpers 24 and 26 which respectively act on upper date ring 4 and lower date ring 6. Drive wheel 18 includes a wheel 40 driven, via a reducer wheel set that is not shown, by hour wheel 34 so as to complete one revolution in twenty-four hours. Two fingers 52 and 54 are fixed, for example by welding, onto wheel 40. These two fingers 42 and 44 drive the respectively upper 4 and lower 6, date rings, by acting on teeth 10 or 12 of said rings. If the thinned tooth 14 of upper date ring 4 is located opposite drive wheel 18, the latter will have no effect on said upper ring 4 and will only drive lower date ring 6, via its finger 44, through one step each day. Conversely, if thinned tooth 16 of lower date ring 6 is located opposite drive wheel 18, finger 44 will not be able to mesh with tooth 16 of said lower ring 6 and only upper ring 4 will move forward one step each day.

Drive wheel 18 is freely mounted on an arbour 46 of bridge 38. Finally, the date mechanism according to the invention is held axially on plate 32 by means of a holding plate 48 fixed using screws 50.

Figure 6:
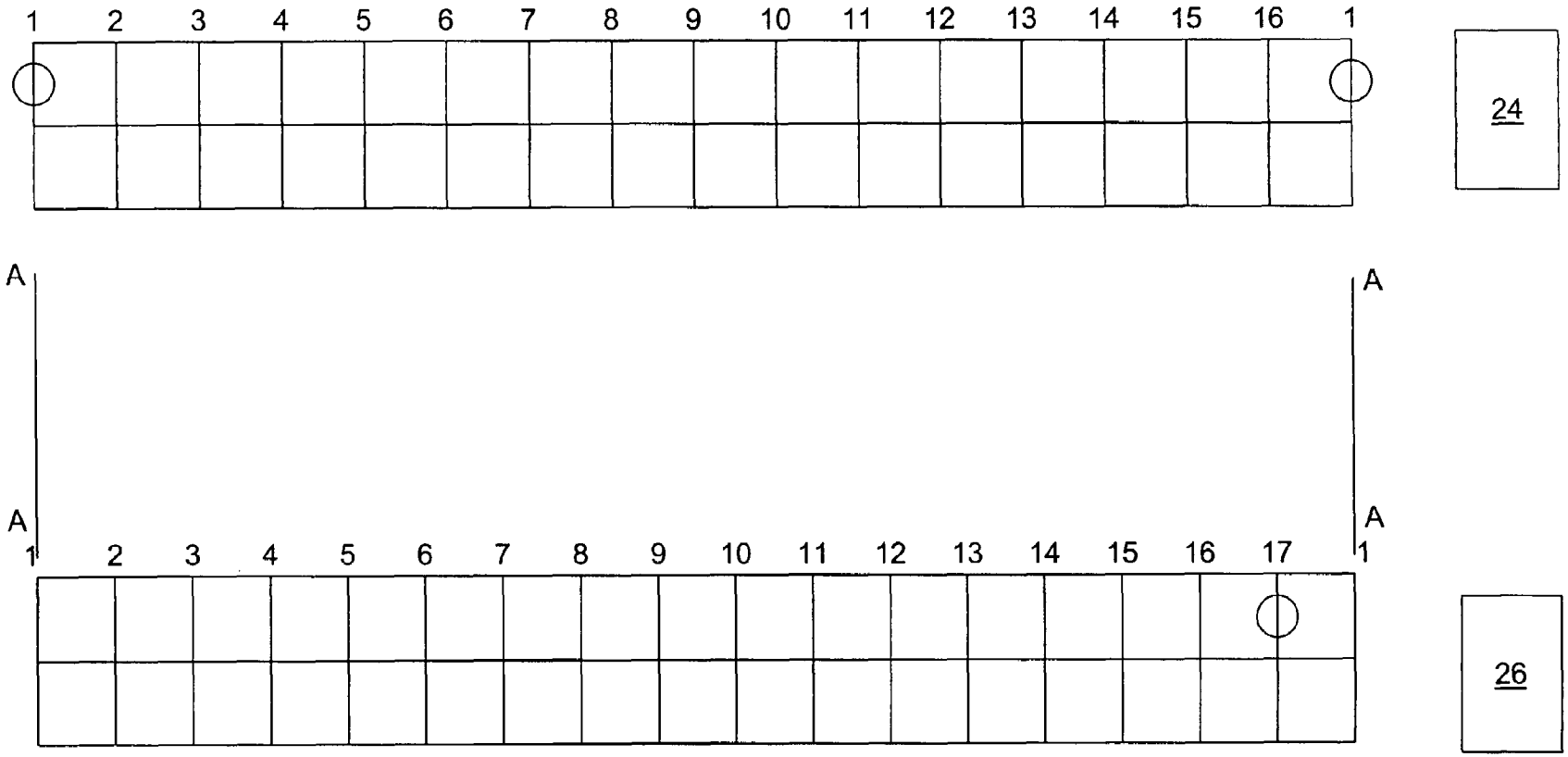
FIG. 6 is a schematic diagram of the peripheral toothings of the lower and upper date rings.

FIG. 6 is an expanded diagram of the toothings of upper and lower date rings 4 and 6. As can be seen upon examining this Figure, upper date ring 4 includes sixteen teeth identified by the numbers 1, 2, . . . , 15 and 16, whereas lower date ring 6 includes seventeen teeth identified by the numbers 1, 2, . . . , 16 and 17. Upper ring 4 thus includes 16 divisions, whereas the lower ring includes 17 divisions. Teeth 10 and 12 of respectively upper and lower date rings 4 and 6 are thus staggered in relation to each other. The positions of thinned teeth 14 and 16 of upper and lower rings 4 and 6 are marked by circles in full lines. The position of drive wheel 18 opposite the toothings of upper ring 4 and lower ring 6 is marked by the straight line segment A—A. Finally, the two jumpers 24 and 26 are represented by two rectangles which bear the same reference numerals. As can be seen upon examining the drawing, the height of the two jumpers 24 and 26 is equal to the thickness of teeth 10 and 12.

In the situation shown in FIG. 6, upper date ring 4 has its thinned tooth 14 opposite drive wheel 18. This position corresponds to the situation in which upper ring 4 has its aperture 8 at display location 20 of the movement and reveals the number "16" borne by lower ring (see also FIG. 4). At the moment when the marking "16" appears, limit stop 30 of lower ring 6 abuts against limit stop 28 of upper ring 4. Thus, during the movement forward that will be imparted to lower ring 6 by drive wheel 18, upper ring 4 will also be driven. It will then be lower ring 6 which will have its thinned tooth 16 opposite drive wheel 18, whereas the thinned tooth 14 of upper ring 4 will have moved forward one step.

As already mentioned hereinbefore, the height of the two jumpers 24 and 26 is substantially equal to the thickness of teeth 10 and 12, such that during the passage of the thinned tooth, respectively 14 or 16, said jumpers still remain engaged between two immediately consecutive teeth of the toothings of the upper and lower discs, guaranteeing proper positioning of said discs.

It goes without saying that the present invention is not limited to the embodiment that has just been described, and that various simple modifications and variants can be envisaged by those skilled in the art without departing from the scope of the present invention. In particular, the upper date ring could include seventeen sectors, while the lower date ring could have only sixteen.

What is claimed is:

1. A date mechanism for a timepiece such as a wristwatch including two superposed respectively lower and upper date rings, whose surface is divided into a plurality of sectors, the upper ring including sixteen sectors, fifteen of which respectively bear fifteen successive markings of a cycle of 31 positions, and the sixteenth of which is an extra sector having an open or transparent aperture, whereas the lower ring includes seventeen sectors, sixteen of which bear respectively the other sixteen markings of the cycle of 31 positions, and the seventeenth of which is an extra sector, each of said rings being provided with a peripheral toothing made of a succession of regularly spaced teeth and cooperating with drive means such that the markings of the lower ring appear successively in a display zone through the aperture, the upper ring remaining immobile, and in that, since the lower ring is immobile, the markings of the upper ring successively appear in the display zone, the upper ring concealing the markings of the lower ring, the date mechanism further including a jumper-effect stopping device able to stop each ring in any desired position, the stopping device being adapted to the pitch of the particular ring concerned, said date mechanism being wherein one location on the upper ring and one location on the lower ring is provided with a thinned tooth and, located between two successive teeth of the toothing of the ring concerned, the position of the drive means with respect to the toothing of the rings being such that when a ring has its extra sector at the location of the display zone, the thinned tooth is located opposite the drive means such that said drive means only drive the other ring, the thinned teeth not disturbing the movement of the drive means and allowing the stopping device to be constantly housed between two successive teeth of each of the rings.

2. The date mechanism according to claim 1, wherein the stopping device includes two jumpers whose height is substantially equal to the thickness of the teeth.

3. The date mechanism according to claim 1, wherein the drive means include a wheel which makes one revolution in 24 hours and which is fitted with two fingers which respectively drive the date rings by acting on their teeth.

4. The date mechanism according to claim 2, wherein the drive means include a wheel which makes one revolution in 24 hours and which is fitted with two fingers which respectively drive the date rings by acting on their teeth.

* * * * *